US005335524A

United States Patent [19]

Sakane

[11] Patent Number: 5,335,524

[45] Date of Patent: Aug. 9, 1994

[54] DRUM TYPE WASHING MACHINE

[75] Inventor: Sakio Sakane, Nagoya, Japan

[73] Assignee: Kabushiki Kaisha Toshiba, Kawasaki, Japan

[21] Appl. No.: 116,208

[22] Filed: Sep. 2, 1993

Related U.S. Application Data

[63] Continuation of Ser. No. 841,365, Feb. 25, 1992, abandoned.

[30] Foreign Application Priority Data

Mar. 1, 1991 [JP] Japan ..... 3-061182

[51] Int. Cl.[5] ..... D06F 33/02

[52] U.S. Cl. ..... 68/12.04; 68/12.02; 68/12.12

[58] Field of Search ..... 68/12.01, 12.02, 12.04, 68/12.12, 139, 140

[56] References Cited

U.S. PATENT DOCUMENTS 3,122,009 2/1964 Jarvis ..... 68/12.04
4,862,710 9/1989 Torita et al. ..... 68/12.04 X

FOREIGN PATENT DOCUMENTS 0373063 6/1990 European Pat. Off. ..... 68/139
0390943 10/1990 European Pat. Off. ..... 68/12.01
2249595 10/1990 Japan ..... 68/12.04

*Primary Examiner*—Philip R. Coe
*Attorney, Agent, or Firm*—Limbach & Limbach

[57] ABSTRACT

A drum type washing machine includes a drum mounted in a water-receiving tub so as to be rotated about its transverse axis in a wash step, a brushless motor for rotating the drum, and a control device for controlling the motor. The rotational speed of the drum is controlled in the wash step so as to be varied in each period of its rotation in a range at least including a speed at which clothes accommodated in the drum are caused to fall down from the inner peripheral wall surface of the drum against centrifugal force.

8 Claims, 5 Drawing Sheets

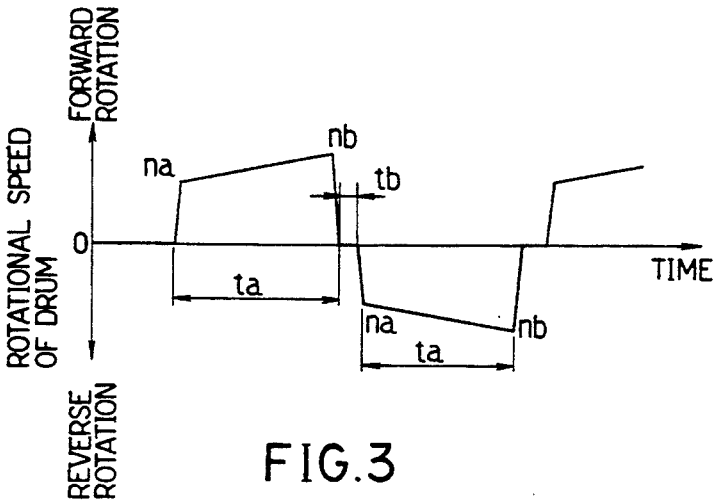
FIG.3
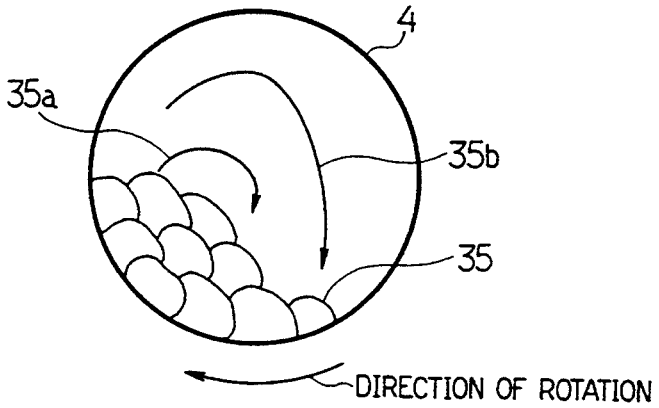
FIG.4
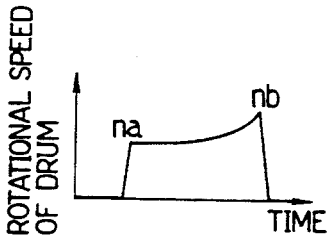
FIG.5(a)
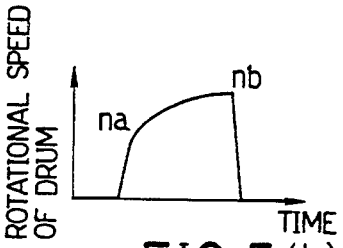
FIG.5(b)
FIG.5(c)
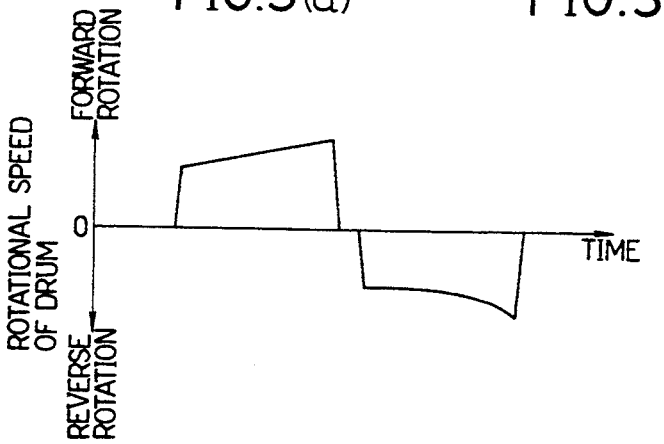

DRUM TYPE WASHING MACHINE

This is a continuation of co-pending application Ser. No. 07/841,365 filed on Feb. 25, 1992 now abandoned.

BACKGROUND OF THE INVENTION

This invention relates to a drum type washing machine wherein a drum accommodating clothes to be washed with wash liquid is rotated about its transverse axis for performing washing.

In conventional drum washing machines, a water-receiving tub is mounted in an outer cabinet and a drum having a number of apertures formed through its peripheral wall is mounted in the water-receiving tub so as to be rotated about its transverse axis. The drum is driven by an electric motor so that wash, rinse and dehydration steps are sequentially executed.

The drum is rotated about its transverse axis alternately in forward and reverse directions in the wash step. With rotation of the drum, the clothes therein are scooped and raised by the inner peripheral wall surface of the drum and then caused to fall down. Such an agitating movement as described above is repeated.

In the conventional drum type washing machine described above, however, a substantially uniform falling locus of the clothes in the drum is maintained during the wash step since the drum is usually rotated at a fixed speed. Consequently, a same agitating mode of the clothes is repeated, which increases the entwining of the clothes, preventing improvement of the washing effect and causing unevenness in cleanness of the washed clothes.

SUMMARY OF THE INVENTION

Therefore, an object of the present invention is to provide a drum type washing machine wherein the clothes in the drum in rotation in the wash step can effectively be restrained from being entwined with one another.

To achieve the above-described object, the present invention provides a drum type washing machine comprising a drum mounted on a suitable support so as to be rotated about a transverse axis thereof, the drum accommodating clothes to be washed with liquid. Drive means is provided for rotating the drum in a wash step so that the clothes are agitated with the liquid in the drum. The drive means includes an electric motor. Rotational speed control means is provided for controlling the drive means so that the rotational speed of the drum is varied during rotation thereof in the wash step in a range including a rotational speed at which the clothes in the drum are caused to fall down from an inner peripheral surface of the drum against a centrifugal force. The rotational speed control means includes means for controlling either voltage applied to the motor or frequency thereof so that the rotational speed of the motor is varied. The rotational speed control means acts to very rapidly bring the rotational speed up to a first predetermined rotational speed in one direction, thereafter to gradually change the rotational speed to a second predetermined rotational speed in said one direction; and to thereafter reduce the rotational speed to zero; and to thereafter rapidly bring the rotational speed up to a third predetermined value which is in the opposite rotational direction; and thereafter to gradually change the rotational speed to a fourth predetermined rotational speed which is in said opposite rotational direction.

The third predetermined value is preferably the same rotational speed as the first predetermined rotational speed and the fourth predetermined rotational speed is preferably equal to the rotational speed of the second predetermined rotational speed.

In accordance with the above-described drum type washing machine, the drum is rotated in the wash step in the rotational speed range including the rotational speed at which the clothes are caused to fall down from the inner peripheral wall surface of the drum. As a result, the clothes are raised by a rotational angle and then caused to fall down. Such a movement of the clothes as described above is repeated so that a washing action is obtained. Furthermore, since the falling loci of the clothes or agitating modes are not uniform but necessarily varied with variations of the rotational speed of the drum. Consequently, the clothes can be restrained from being entwined with one another since the agitating modes include the one that acts so that entwined clothes are disentangled.

The drive means may preferably comprise a brushless motor and the rotational speed control means may comprise voltage control means for or feedback controlling a duty ratio of a pulse voltage applied to the brushless motor so that the rotational speed of the motor is varied.

Furthermore, it is preferable that the drive means comprise a brushless motor and the rotational speed control means comprise voltage control means for controlling a duty ratio of a pulse voltage applied to the brushless motor so that the rotational speed of the motor is varied, load volume detecting means for detecting the volume of the clothes accommodated in the drum, and rotational speed variation pattern control means for controlling the voltage control means so that the brushless motor is supplied with a pulse voltage with a duty ratio corresponding to the volume of the clothes detected by the load volume detecting means.

Other objects of the present invention will become obvious upon understanding of the illustrative embodiments about to be described. Various advantages not referred to herein will occur to one skilled in the art upon employment of the invention in practice.

BRIEF DESCRIPTION OF THE DRAWINGS

The preferred embodiments will be described with reference to the accompanying drawings in which:

FIG. 3 is graph showing variation patterns of the rotational speed of the drum;

FIG. 4 is a schematic sectional view of the drum for showing agitation of the clothes in the drum;

FIGS. 5(*a*) through 5(*c*) are similar to FIG. 3 showing different modes of the variation patterns of the rotational speed of the drum;

DESCRIPTION OF THE PREFERRED EMBODIMENTS

Figure 1:
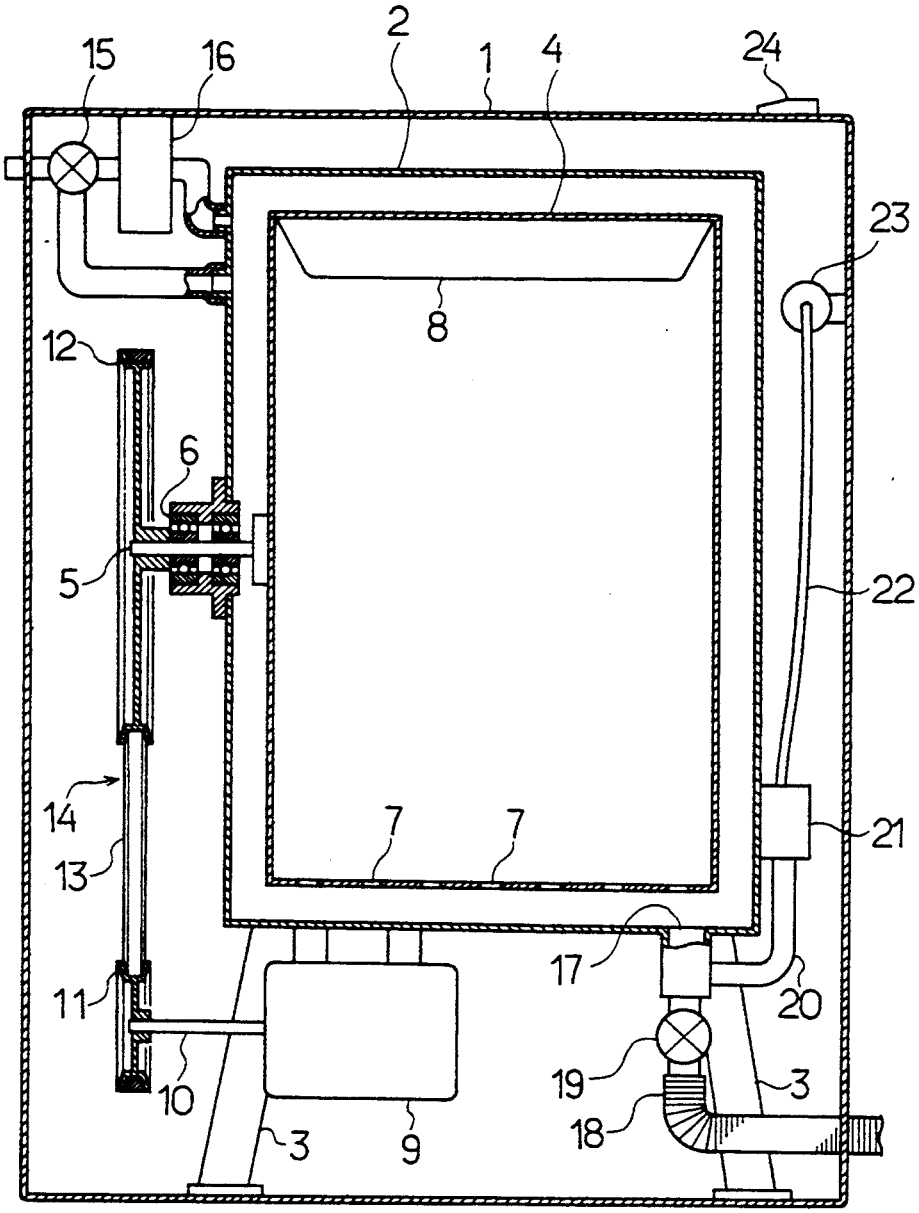
FIG. 1 is a schematic longitudinal sectional view of the drum type washing machine of a first embodiment in accordance with the present invention.

A first embodiment of the present invention will be described with reference to FIGS. 1 through 4. Referring to FIG. 1 showing an overall construction of the drum type washing machine, an outer cabinet 1 encloses a water-receiving tub 2 held by a well known elastic suspension mechanism 3. A drum 4 is mounted on a support shalt 5 and a bearing 6 so as to be rotated about its transverse axis in the water-receiving tub 2. The drum 4 has a number of apertures formed through the peripheral wall thereof substantially over its entire area. The drum 4 has a baffle 8 formed on its inner surface for scooping clothes in a wash step.

An electric motor 9 is mounted on the outer bottom of the tub 2. A belt transmission mechanism 14 is provided between a rotational shaft 10 of the motor 9 and the support shaft 5 of the drum 4. The belt transmission mechanism 14 comprises pulleys 11 and 12 and a belt 13. Rotation of the motor 9 is transmitted to the drum 4 through the belt transmission mechanism 14. The reduction ratio of the belt transmission mechanism 14 is set to 10:1 in the embodiment. A brushless d.c. motor with a three-phase stator winding is employed as the motor 9 in the embodiment. A drive circuit for the motor 9 will be described later.

An electromagnetic water supply valve 15 of a three-way switching type is provided in the upper inside of the outer cabinet 1. The water supply valve 15 is switched among three states, that is, a first state tot supplying water to the tub 2 with the water passing through a detergent dispenser (not shown), a second state for supplying water to the tub 2 with the water not passing through the detergent dispenser, and a third state for interrupting the water supply to the tub 2.

The tub 2 is provided with a drain hole 17 formed in the outer bottom thereof. A drain tube 18 is coupled to the drain hole 17 with an electromagnetic drain valve 19 interposed therebetween. The drain tube 18 extends outside the outer cabinet 1. A water head pressure transmission pipe 20 is coupled to the drain tube 18 in the vicinity of the drain hole 17. An air trap 21 is mounted on the upper end of the water head pressure transmission tube 20. The pneumatic pressure in the air trap 21 is applied through a tube 22 to a water level sensor 23 comprising a pressure sensor. An operation section 24 is provided in the top of the outer cabinet 1. Various switches 25 (see FIG. 2) and a display 26 (see FIG. 2) are provided in the operation section 24.

Figure 2:
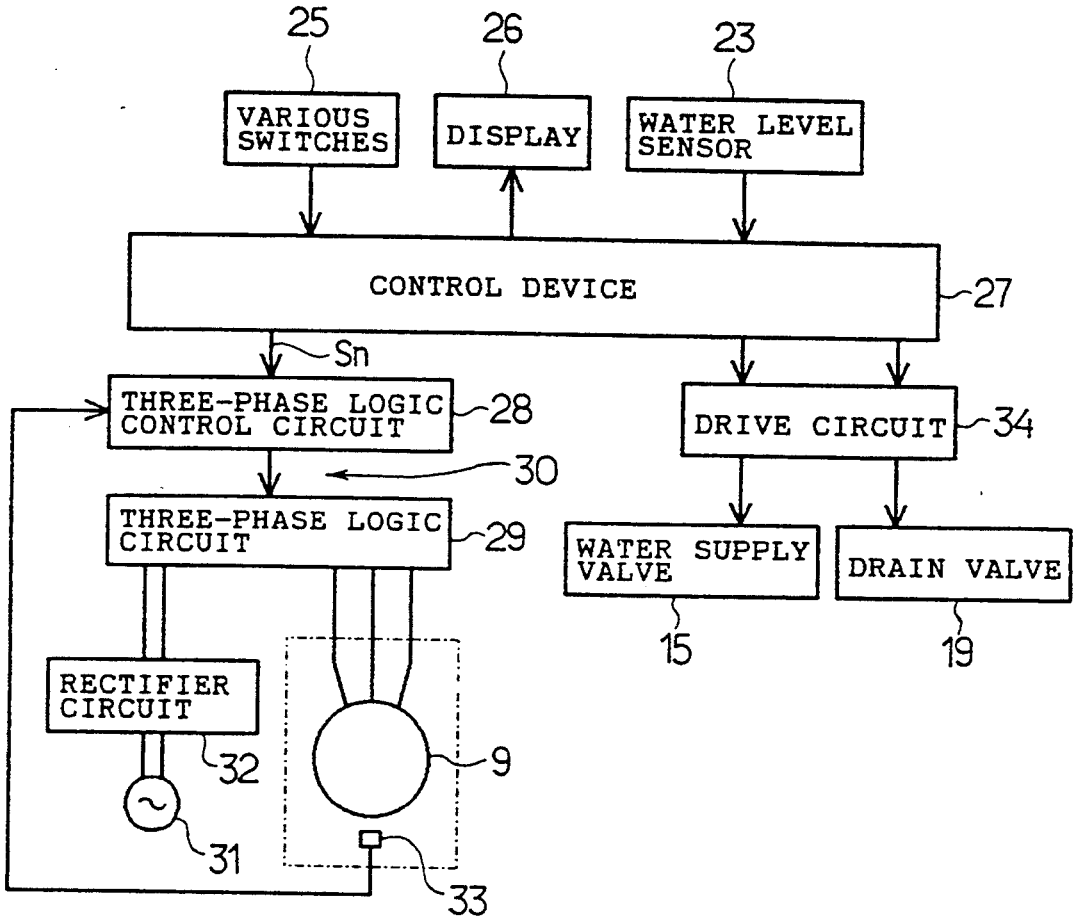
FIG. 2 is a block diagram snowing an electrical arrangement of the drum type washing machine.

An electrical arrangement of the drum type washing machine will now be described with reference to FIG. 2. A control device 27 comprises a microcomputer having a storage (not shown) for storing an operation program for controlling a washing operation including a wash step, an intermediate dehydration step, a rinse step and a final dehydration step. The drum 4 is rotated in a predetermined rotational speed pattern in the wash step, as will be described later.

The control device 27 supplies a three-phase logic control circuit 28 with a rotational speed reference signal $S_n$. The three-phase logic control circuit 28 constitutes a motor drive circuit 30 together with a three-phase logic circuit 29. The three-phase logic control circuit 28 also serves as rotational speed control means or voltage control means. Upon receipt of the rotational speed reference signal $S_n$ from the control device 27, the three-phase logic control circuit 28 supplies a pulse-width modulation (PWM) signal with a duty ratio according to the rotational speed reference signal to the three-phase logic circuit 29 constituting the motor drive means. The three-phase logic circuit 29 comprises transistors arranged in three-phase bridge connection as well known in the art. A d.c. power supplied to the three-phase logic circuit 29 from a rectifier circuit 32 rectifying an a.c. power from a commercial a.c. power source 31. The motor 9 is provided therein with a Hall IC 33 serving as a position sensing element for sensing a rotational angular position of a rotor of the motor 9. A position detection signal generated by the Hall IC 33 is supplied to the three-phase logic control circuit 28, which circuit then determines a timing energizing the stator winding of the motor 9, based on the position detection signal.

The above-described position detection signal also serves as a speed detection signal for feedback controlling the motor 9. The three-phase logic control circuit includes comparison means (not shown) for comparing the speed detection signal with the rotational speed reference signal $S_n$ in order that duty ratio of the PWM signal is controlled so that the speed detection signal corresponds to the rotational speed reference signal $S_n$. The three-phase logic circuit 29 converts an input voltage from the rectifier circuit 32 to a pulse voltage by means of the PWM signal from the three-phase logic control circuit 28. The pulse voltage is applied to the motor 9 and accordingly, the motor 9 is rotated at the rotational speed in accordance with an effective input voltage value depending upon the duty ratio of the pulse width of the pulse voltage.

In response to inputs from the various switches 25 and the input from the water level sensor 23, the control device 27 controls the water supply valve 15 and the drain valve 19 via a drive circuit 34, the display 26 and the motor 9 via the drive circuit 30, thereby controlling the wash step.

The control device 27 functions as rotational speed reference signal generating means. For this purpose, the operation program stored in the control device 27 contains data of the rotational speed reference signals corresponding to drive patterns including patterns of forward and reverse rotations of the drum 4 and patterns of rotational speed variations of the drum 4 in the wash step, as is shown in FIG. 3. More specifically, the drum 4 is forward rotated for the time period $t_a$, interrupted for the time period $t_b$, and reverse rotated for the time period $t_a$, repeatedly. The rotational speed of the drum 4 is varied so as to be linearly increased from the value $n_a$ to the value $n_b$. The high rotational speed $n_b$ is set as described below. The rotational centrifugal force P [kg·m/s²] is given by the following equation (1):

$$P = r \cdot \omega^2 \cdot W \quad (1)$$

where W [kg] is a mass, r [m] is the inner radius of the drum 4, and [rad/s] is the angular velocity. When the term $r \cdot \omega^2$ is 1 g or below where g is gravitational acceleration [m/s²], the clothes in the drum 4 are caused to fall down since a force causing the clothes to fall down is larger than a force urging the clothes onto the inner surface of the drum 4. Accordingly, the relation between the value of $r \cdot \omega^2$ and the value of g is determined by the following equation (2), for example:

$$r \cdot \omega^2 = 0.8 \cdot g. \quad (2)$$

When the rotational speed N [r.p.m.] is substituted for the angular velocity in the case of equation (2), the speed N is given by the following equation (3):

$$N = \frac{60 \cdot \sqrt{0.8\, g/r}}{2\pi} \quad (3)$$

The rotational speed N can be given by equation (3) when substituted for the angular velocity $\omega$. The rotational speeds $n_a$, $n_b$ are thus set in the range not exceeding the rotational speed N.

The control device 27 is provided with the function of varying the rotational speed of the drum 4. More specifically, the control device 27 supplies the three-phase logic control circuit 28 with the rotational speed reference signal $S_n$ in the wash step so that the rotational speed of the drum 4 is varied from the value $n_a$ to the value $n_b$ in the time period $t_a$ or during its rotation. The three-phase logic control circuit 28 then supplies the three-phase logic circuit 29 with the PWM signal in accordance with the rotational speed reference signal $S_n$. The voltage according to the PWM signal is applied to the motor 9 by the three-phase logic circuit 29. Consequently, the motor 9 is feedback controlled so as to be driven to be rotated at the rotational speeds according to the rotational speed reference signal $S_n$. The rotational speed of the drum 4 is varied in each period of rotation in the wash step as shown in FIG. 3.

The rotational speed of the drum 4 is thus varied in the wash step, as described above. A falling locus of the clothes in the drum 4 is also varied with variations of the rotational speed of the drum 4. More specifically, the clothes 35 are raised to a relatively high position and then caused to fall down as shown by arrow 35*b* in FIG. 4 when the rotational speed of the drum 4 is high (at the speed $n_b$), while the clothes 35 are caused to fall down from a relatively low position as shown by arrow 35*a* when the drum rotational speed is low (at the speed $n_a$). Since the rotational speed of the drum 4 is continuously varied in the range between the value $n_a$ and the value $n_b$, a large number of patterns of the falling locus are obtained and accordingly, the agitation of the clothes is varied in a large number of modes. Consequently, the clothes can be restrained from being entwined with one another, the washing effect can be improved, and the unevenness in cleanness of the washed clothes can be prevented. Experiments carried out by the inventor show that washing can be performed effectively when $n_a$, $n_b$, $t_a$, $t_b$, and r take the values of 40 r.p.m., 55 r.p.m., 15 sec., 5 sec., and 220 mm (or 0.22 m) respectively.

Although the rotational speed of the drum 4 is varied linearly from the value $n_a$ to $n_b$ in the foregoing embodiment, the rotational speed variation pattern may be a curved one as shown in FIGS. 5(*a*)and 5(*b*) as a modification of the embodiment. Furthermore, although the rotational speed of the drum 4 is varied in one and the same mode in the time periods of the forward and reverse rotation of the motor 9 in the foregoing embodiment, the drum rotational speed may be varied in the modes different from each other in the time periods of the motor forward and reverse rotation, as is shown in FIG. 5(*c*).

Figure 6:
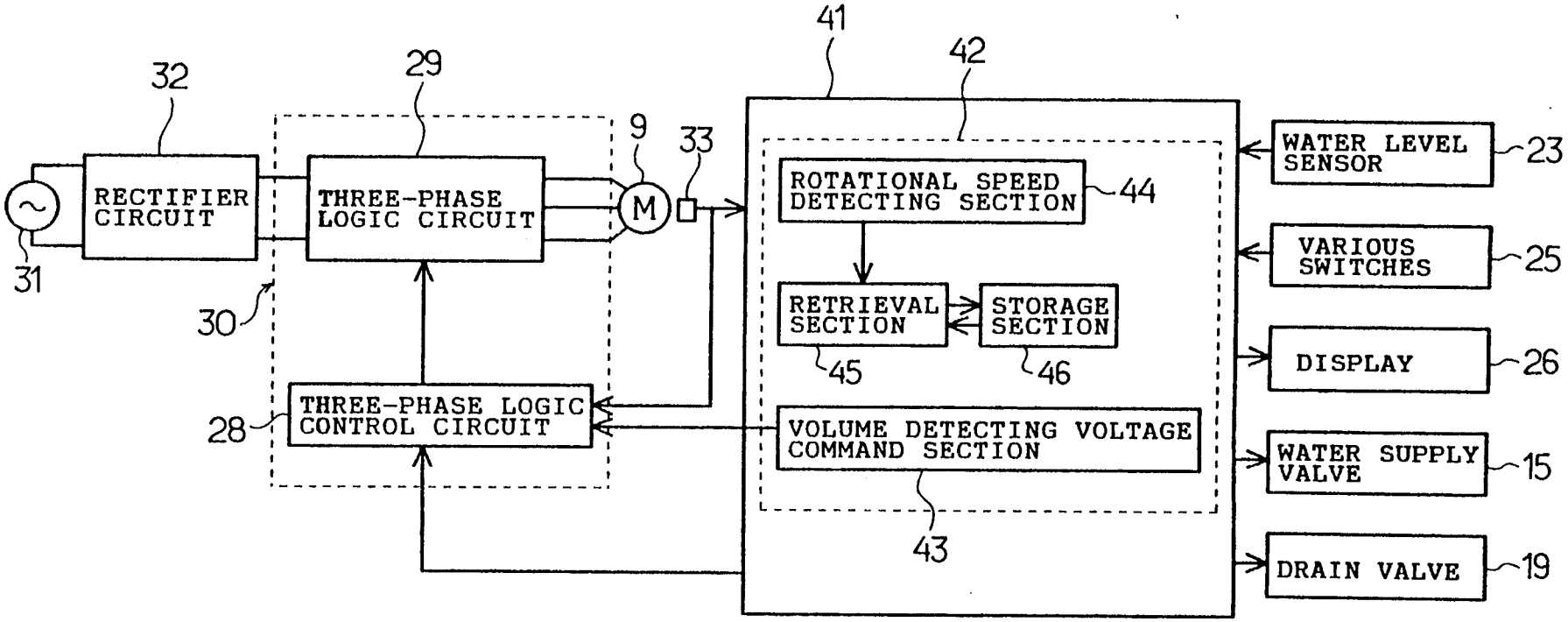
FIG. 6 is a view similar to FIG. 2 showing a second embodiment of the invention.
Figure 7:
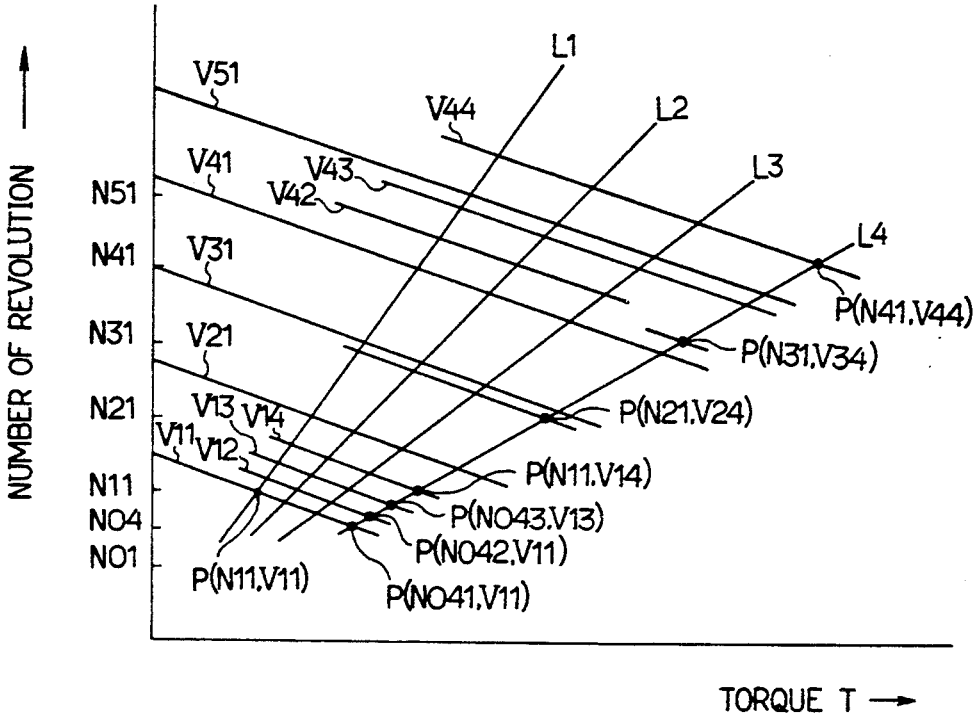
FIG. 7 is a graph showing contents of load volume determining data employed in the drum type washing machine of the second embodiment.

FIGS. 6 and 7 illustrate a second embodiment of the invention. Describing the difference between the first and second embodiments, a control device 41 includes clothes volume detecting means 42 incorporated in the rotational speed varying means. The clothes volume detecting means 42 comprises a volume detecting voltage command section 43, a rotational speed detecting section 44, a retrieval section 45 and a storage section 46.

The volume detecting voltage command section 4 3 delivers a voltage of a predetermined value as a command value to the three-phase logic control circuit 28. Based on the signal from the Hall IC 33, the rotational speed detecting section 44 detects the rotational speed of the motor 9 in rotation at the voltage applied thereto according to the above-mentioned voltage command value. A rotational speed detection value is supplied to the retrieval section 45, which section determines the volume of the clothes based on data of volume determination stored in the storage section 46. The volume determination data contains a data table indicative of values of the voltage applied to the motor 9 and the rotational speeds corresponding to the values of voltage for respective different load volumes. The volume determination data has been obtained from experiments though concrete numeric values are not shown. The axis of ordinates represents torque T and the axis of abscissas represents rotational speed N in the graph of FIG. 7. The relations between the voltage applied to the motor 9 and the rotational speed when an amount of load applied to the motor 9 takes the values $L_1$, $L_2$, $L_3$ and $L_4$, which load amount depends upon the volume of the clothes to be washed. For example, in the case where the amount of load takes the value $L_1$, the rotational speed takes the value $N_{11}$ when the voltage $V_{11}$ is applied to the motor 9. From another point of view, the voltage applied to the motor 9 takes the value $V_{11}$ when the rotational speed reaches the value $N_{11}$ in the condition of the load amount $L_1$ with the applied voltage gradually increased from zero. Since the torque T is approximately proportional to the current, the amount of load can be obtained when two of three factors, current, applied voltage and rotational speed, are found. In the embodiment the voltage to be applied to the motor 9 is previously determined at an initial stage of the wash step and the rotational speed of the motor 9 is detected. Based on the detected rotational speed, the amount of load, that is, the volume of clothes is determined. A clothes volume detection signal indicative of the detected volume clothes is utilized for controlling the three-phase logic control circuit 28 so that the three-phase logic circuit 29 delivers, as an initial value at starting in each period rotation, the pulse voltage having the duty ratio corresponding to the volume of clothes. Control of the motor 9 is transferred to the feedback control as in the foregoing embodiment after its starting period elapses.

Although the clothes are caused to fall down from the drum inner peripheral wall surface at all the speeds of each rotational speed variation pattern in the foregoing embodiments, each pattern may include the upper limit speed at which the clothes cannot stand against the centrifugal force to be forced to rotate with the drum 4. In short, each rotational speed variation pattern may include at least one rotational speed at which the clothes are caused to fall down from the drum inner peripheral wall surface.

Although the brushless motor is employed as the motor 9 in the foregoing embodiments, those of other types may be employed wherein the rotational speed is varied in accordance with the input voltage value or the frequency of the input voltage.

The foregoing disclosure and drawings are merely illustrative of the principles of the present invention and are not to be interpreted in a limiting sense. The only limitation is to be determined from the scope of the appended claims.

I claim:

1. A drum type washing machine comprising:

a) a drum mounted on a suitable support so as to be rotated about a transverse axis thereof, the drum accommodating clothes to be washed with liquid;

b) a brushless motor for rotating the drum in a wash step so that the clothes are agitated with the liquid in the drum;

c) rotational speed detecting means for detecting a rotational speed of the brushless motor and generating a speed detection signal;

d) means for generating a rotational speed reference signal corresponding to a drive pattern for driving the brushless motor so that the rotational speed of the drum is varied during rotation thereof in the wash step in a range including a rotational speed at which the clothes in the drum are caused to fall down from an inner peripheral surface of the drum against a centrifugal force; and e) a logic control circuit generating a PWM signal for driving the brushless motor, the logic control means including comparison means for comparing the speed detection signal generated by the rotational speed detecting means with the rotational speed reference signal for controlling a duty ratio of the PWM signal so that the brushless motor is feedback controlled.

2. A drum type washing machine comprising:

a) a drum mounted on a suitable support so as to be rotated about a transverse axis thereof, the drum accommodating clothes to be washed with liquid;

b) a brushless motor for rotating the drum in a wash step so that the clothes are agitated with the liquid in the drum; and c) rotational speed control means for controlling the brushless motor so that a rotational speed of the drum is varied during rotation thereof in the wash step in a range including a rotational speed at which the clothes in the drum are caused to fall down from an inner peripheral surface of the drum against a centrifugal force, the rotational speed control means including load volume detecting means for detecting a volume of clothes in the drum and means for controlling a pulse voltage applied to the brushless motor so that the pulse voltage has a duty ratio corresponding to the volume of clothes detected by the load volume detecting means.

3. A drum type washing machine according to claim 2, wherein the load volume detecting means includes storage means for storing a data table indicating relations between a voltage applied to the brushless motor and the rotational speed thereof at different load volumes, rotational speed detecting means for detecting the rotational speed of the brushless motor and generating a speed detection signal, retrieval means for retrieving the data table stored in the storage means based on data indicative of the speed detection signal generated by the rotational speed detecting means and data indicative of the voltage applied to the brushless motor, thereby generating a load volume detection signal indicative of the load volume data corresponding to both of the data.

4. A drum type washing machine comprising:

a) a drum mounted on a suitable support so as to be rotated about a transverse axis thereof, the drum accommodating clothes to be washed with liquid;

b) a brushless motor for rotating the drum in a wash step so that the clothes are agitated with the liquid in the drum;

c) rotational speed detecting means for detecting a rotational speed of the brushless motor and generating a speed detection signal;

d) means for generating a rotational speed reference signal corresponding to a drive pattern for driving the brushless motor so that the rotational speed of the drum is varied during rotation thereof in the wash step in a range including a rotational speed at which the clothes in the drum are caused to fall down from an inner peripheral surface of the drum against a centrifugal force;

e) a logic control circuit generating a PWM signal for obtaining a pulse voltage for driving the brushless motor, the logic control circuit including comparison means for comparing the speed detection signal generated by the rotational speed detecting means with the rotational speed reference signal for controlling a duty ratio of the PWM signal so that the brushless motor is feedback controlled;

f) load volume detecting means for detecting a volume of clothes in the drum; and g) means for controlling the pulse voltage applied to the brushless motor so that an initial value of the pulse voltage applied to the brushless motor has a duty ratio corresponding to the volume of clothes detected by the load volume detecting means.

5. A drum type machine comprising:

a) a drum mounted on a suitable support so as to be rotated about a transverse axis thereof, the drum accommodating clothes to be washed with liquid;

b) drive means for rotating the drum in a wash step so that the clothes are agitated with the liquid in the drum, the drive means including an electric motor; and c) rotational speed control means for controlling the drive means so that a rotational speed of the drum is varied during rotation thereof in the wash step in a range including a variety of rotational speeds wherein the clothes in the drum are caused to fall down from different angular positions around an inner peripheral surface of the drum against a centrifugal force;

wherein the rotational speed control means includes means for controlling either voltage applied to the motor or frequency thereof so that the rotational speed of the motor is varied; and wherein the rotational speed control means acts to very rapidly bring the rotational speed up to a first predetermined rotational speed in one rotational direction and thereafter to gradually change the rotational speed to a second predetermined rotational speed in said one rotational direction; thereafter to reduce the rotational speed to zero; to thereafter rapidly bring the rotational speed up to a third predetermined value which is in the opposite rotational direction; and thereafter to gradually change the rotational speed to a fourth predetermined rotational speed which is in said opposite rotational direction.

6. A drum type washing machine according to claim 5, wherein the third predetermined value is the same rotational speed as the first predetermined rotational speed and the fourth predetermined rotational speed is equal to the rotational speed of the second predetermined rotational speed.

7. A drum type washing machine comprising:

a) a drum mounted on a suitable support so as to be rotated about a transverse axis thereof, the drum accommodating clothes to be washed with liquid;

b) drive means for rotating the drum in a wash step so that the clothes are agitated with the liquid in the drum, the drive means including a brushless motor; and c) rotational speed control means for controlling the drive means so that a rotational speed of the drum is varied during rotation thereof in the wash step in a range including a variety of rotational speeds wherein the clothes in the drum are caused to fall down from different angular positions around an inner peripheral surface of the drum against a centrifugal force;

wherein the rotational speed control means includes voltage control means for controlling a duty ratio of a pulse voltage applied to the brushless motor so that the rotational speed of the brushless motor is varied; and wherein the rotational speed control means acts to very rapidly bring the rotational speed up to a first predetermined rotational speed in one rotational direction and thereafter to gradually change the rotational speed to a second predetermined rotational speed in said one rotational direction; thereafter to reduce the rotational speed to zero; and to thereafter rapidly bring the rotational speed up to a third predetermined value which is in the opposite rotational direction; thereafter to gradually change the rotational speed to a fourth predetermined rotational speed which is in said opposite rotational direction.

8. A drum type washing machine according to claim 7, wherein the third predetermined value is the same rotational speed as the first predetermined rotational speed and the fourth predetermined rotational speed is equal to the rotational speed of the second predetermined rotational speed.

* * * * *